United States Patent [19]

Hayashi

[11] Patent Number: 4,647,108

[45] Date of Patent: Mar. 3, 1987

[54] DEVICE FOR CONTROLLING HEADREST OF TREATMENT EQUIPMENT

[75] Inventor: Kazuo Hayashi, Kyoto, Japan

[73] Assignee: Kabushiki Kaisha Morita Seisakusho, Kyoto, Japan

[21] Appl. No.: 673,576

[22] Filed: Nov. 21, 1984

Related U.S. Application Data

[63] Continuation-in-part of Ser. No. 615,046, May 29, 1984, abandoned, which is a continuation of Ser. No. 254,068, Apr. 14, 1981, abandoned.

[30] Foreign Application Priority Data

Apr. 14, 1980 [JP] Japan ..... 55-50063

[51] Int. Cl.[4] ..... A47C 1/10; A61G 15/00

[52] U.S. Cl. ..... 297/391; 248/409; 297/410

[58] Field of Search ..... 297/391, 410; 403/321, 403/322, 325; 5/434, 436; 248/118, 408, 409, 423

[56] References Cited

U.S. PATENT DOCUMENTS

| | | | |
|---|---|---|---|
| 1,937,254 | 11/1933 | Stoll | 248/408 X |
| 2,016,132 | 10/1935 | Bergslien | 248/409 |
| 2,171,653 | 9/1939 | Heitmann | 248/409 |
| 2,740,467 | 4/1956 | Page | 297/410 X |
| 3,608,965 | 9/1971 | Cziptschirsch et al. | 248/423 X |
| 4,082,354 | 4/1978 | Renner et al. | 297/391 X |
| 4,256,341 | 3/1981 | Goldner et al. | 297/410 |

*Primary Examiner*—Kenneth J. Dorner
*Assistant Examiner*—Peter R. Brown
*Attorney, Agent, or Firm*—Koda and Androlia

[57] ABSTRACT

A device for controlling a headrest of a treatment equipment to be used for dental and medical treatment. The device comprises an arcuate support shaft connected to said headrest with the center of radius of curvature of the shaft positioned above said backrest, a guide sheath provided inside the top of said backrest, said sheath having an arcuate guide groove slidably receiving said support shaft, a lock mechanism for locking said support shaft in a suitable position in said guide groove, and lock releasing mechanism for unlocking said support shaft.

3 Claims, 11 Drawing Figures

DEVICE FOR CONTROLLING HEADREST OF TREATMENT EQUIPMENT

This is a continuation-in-part of application Ser. No. 615,046, filed 5/29/84, abandoned, which is a continuation of application Ser. No. 254,068, filed 4/14/81, abandoned.

BACKGROUND OF THE INVENTION

1. Field of the Invention

This invention relates to a device for controlling a headrest used in a treatment equipment and more particular, to a device for controlling tilting of the headrest to maintain such headrest in comfortable agreement with a patient's head on a headrest of a treatment equipment, such as a dental or medical treatment chair.

2. Prior Art

In the prior art, there have been known a number of headrest controlling devices used for treatment chairs and the like. For example, a device as shown in FIG. 1 has a structure such that a support shaft 51 of a headrest 4 is rotatably connected to a backrest 1 by a pivot 11 inside the backrest 1. Another device as shown in FIG. 2 has a support shaft 52 which is fixedly connected to the backrest 1 but the headrest 4 is movably connected by fitting a cam 62 over a cam 72, the cams being adapted to be fitted one over the other, so as to tiltably control the headrest 4 itself. Another device has been proposed and disclosed by the present Applicant in detail in Japanese Utility Model Publication No. 14477/1974, in which a headrest is moved up and down tiltably with respect to the backrest. The devices mentioned above are all intended to improve the functions of headrest in medical and dental treatment.

However, the prior art devices of the kind described above have been developed for the convenience of an operator, namely, from the standpoint exclusively of the operator and no or little consideration has been given to patients. It is generally desirable that medical treatment chairs be designed to be controlled so as to be freely movable in accordance with a change in the position of a patient resting on the chairs and to be held in a specified fixed state during treatment. Accordingly, it is essential that a headrest mounted to such treatment chair function in like manner. Viewed from the point described, the conventional devices of the type described above appear to pose no problem.

However, the problems common to the prior art devices are that because the center of rotation of the cervical vertebrae of a patient is placed in a different position from the center of rotation of the headrest, the head of the patient put on the headrest does not agree in movement with the headrest, which necessarily results in unnatural position on the part of the patient with the tilting of the head of the patient, with the result that the patient cannot be free from uncomfortable feeling. For this reason, the drawbacks described above cannot be ignored in practicing medical treatment. This is particularly important for the treatment of tooth, eye and nose, wherein the head of a patient is tilted and must be held in a specified spine position to undergo treatment.

For example, in FIG. 1, the locus of rotation A described with the center of rotation O″ of a headrest 4 as a center is not in agreement with the locus of tilting B described with the center of tilting O of the cervical vertebrae of the head region of the human body as a center and both loci are those described respectively as shown by arrows. Accordingly, when the headrest 4 is tilted and shifted from the state in FIG. 1A to that in FIG. 1B, the head H of a patient P physically slips out of position in the direction of a backrest 1 (in the direction indicated by arrow O), and the patient P feels that his cervical vertebrae are drawn so much more than is required that he feels uncomfortable and finds it necessary to adjust his posture, with the result that an operator tends to be hindered in his smooth treatment activities. The conventional device shown in FIG. 2 works on the same principle and the patient P is not protected against unnecessary sense of oppression given to his cervical vertebrae when he is shifted in position from the state in FIG. 2A to that in FIG. 2B. Also, the device the present Applicant previously proposed was not free from similar problems either.

The problems common to the prior art are due to the fact that corrections and improvements were made exclusively from the convenience for the operator rather than the patients.

SUMMARY OF THE INVENTION

Accordingly, the primary object of the invention is to provide a device for controlling tilting of a headrest designed to movably control a headrest to maintain the headrest in comfortable agreement with the tilting of the head of a patient placed on the headrest.

Another object of the invention is to provide a device for controlling tilting of a headrest which does not force a patient to take an unnatural position and accordingly, does not make him uncomfortable and which is easy for the operator to manipulate and is developed from the study of human body.

These and other objects of the invention are achieved by the device for controlling headrest tilt which comprises an arcuate support shaft secured at one end to the lower part of the headrest with the center of radius or curvature of the shaft positioned above said backrest, a guide sheath provided inside of the top of a backrest and receiving said support shaft and having an arcuate guide groove corresponding to the curvature of the support shaft, a lock mechanism constructed to lock the support shaft at a suitable postion in the guide groove, and a lock releasing mechanism for releasing the lock mechanism.

DETAILED DESCRIPTION OF THE INVENTION

Figure 1A:
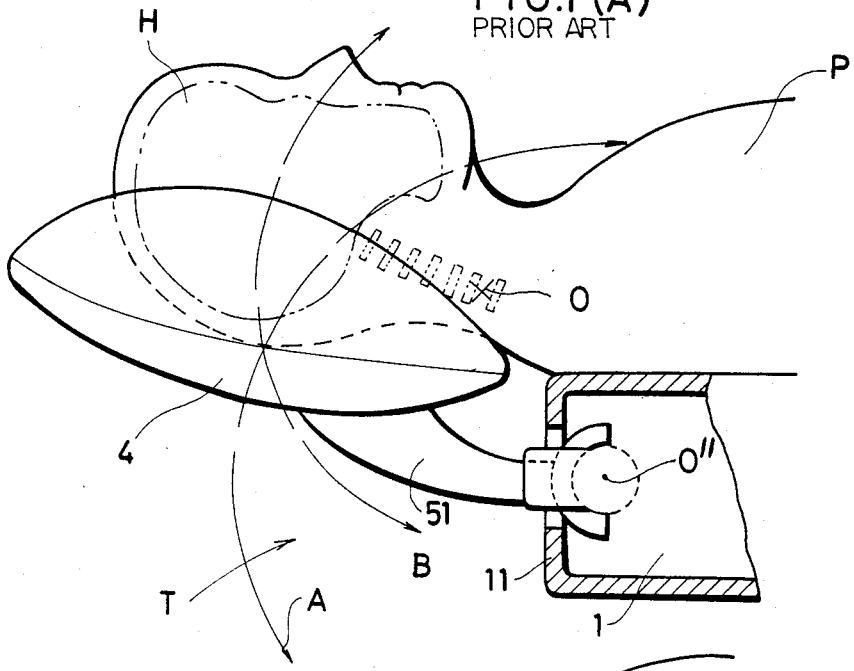
FIG.1(A) PRIOR ART
FIGS. 1A and 1B show a cross-section of a prior art headrest.
Figure 1B:
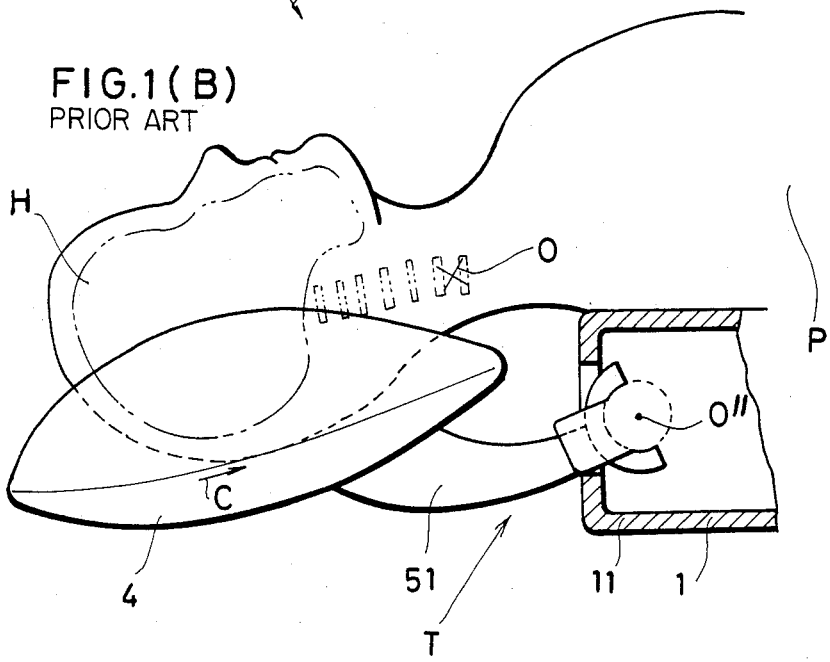
FIG.1(B) PRIOR ART
Figure 2A:
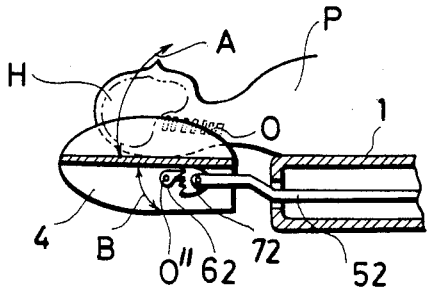
FIG. 2(A) PRIOR ART
FIGS. 2A and 2B show a cross-section of another prior art headrest.
Figure 2B:
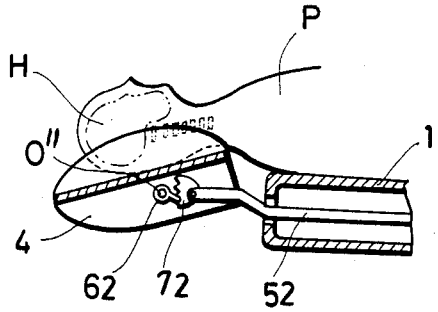
FIG. 2(B) PRIOR ART
Figure 3:
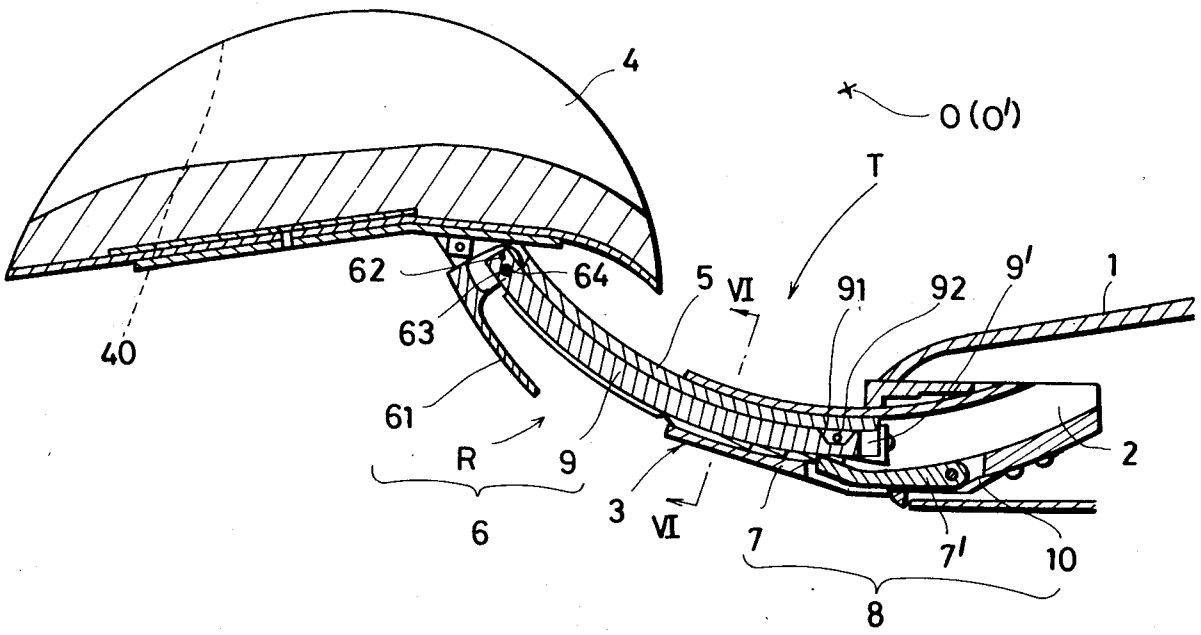
FIG. 3 is a longitudinal cross-section of one embodiment of the device of the invention and enlargements of detail thereof.
Figure 4:
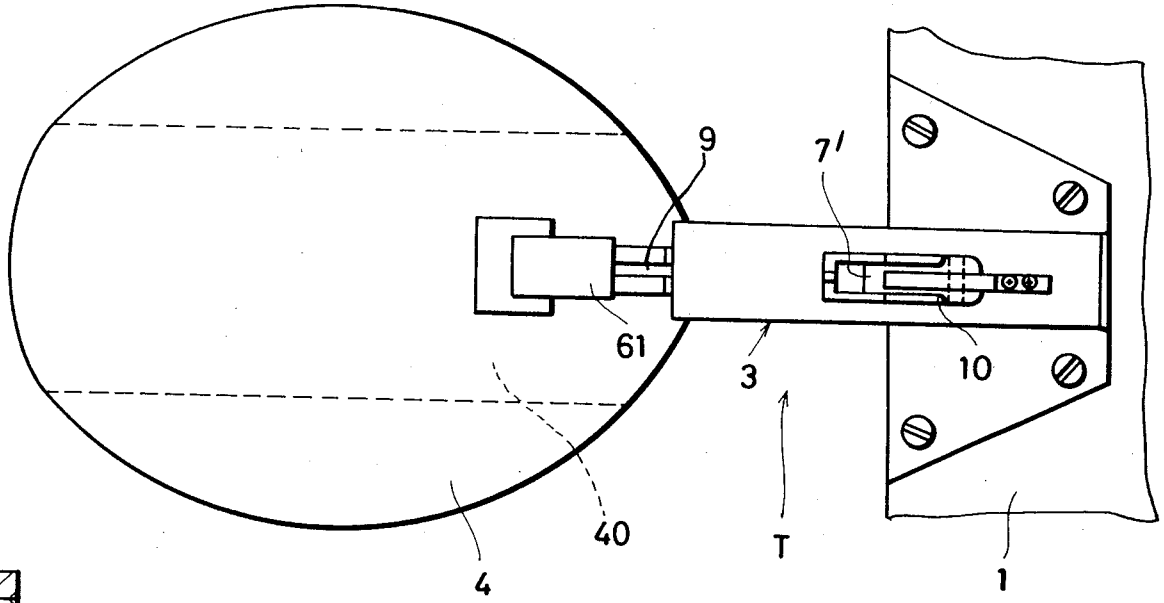
FIG. 4 is a bottom plan view of the embodiment.

First referring to FIG. 3 shown is one embodiment of the invention wherein the numeral 4 designates a headrest having a dent 40 for receiving the back of the head of a patient on the middle thereof. Numeral 5 designates an arcuate support shaft secured at the upper end to the lower part of the headrest 4 and is slidably put at its main body within an arcuate guide groove 2 provided in a guide sheath 3 mounted inside the top of a backrest 1. The curvature of the support shaft 5 constitutes a most important part of the invention and the curvature is determined based upon the result of follow-up investigation of the locus of the head H of a patient P placed on the backrest 4. The center of radius of curvature of the shaft 5 is determined by comprehensive consideration of the relative positional relation which the backrest 1, headrest 4 and the head H of a patient make between each other so that the center of radius of curvature A of the shaft may constitute the center of rotation O of the cervical vertebrae of the patient P which is approximately the center of the locus of the head H of a patient P placed on the backrest 4. A lock mechanism 8 functions to lock the shaft 5 at a suitable point in the guide groove 2 within the guide sheath 3, and the mechanism 8 in the embodiment illustrated comprises ratchet teeth 7 . . . formed along the longitudinal extension of the underside of the shaft 5 and a ratchet pawl 7' swingably depressedly fixed by a leaf spring 10 to the base portion of the guide sheath 3. A lock releasing mechanisms 6 comprises an operation handle 61 pivotally connected to the upper end portion of the shaft 5, and an arcuate cam 9 incorporated in a cam groove 9' so as to move along the curvature of the shaft 5.

The arcuate cam 9 is designed to be freely moved into and out of the cam groove 9' by operation of the handle 61. The cam groove 9' provided in the shaft 5 longitudinally thereof divides a ratchet 7 longitudinally thereof into two. The numeral 62 designates a pivot that connects the upper end of the cam 9 to the handle 61 within the support shaft 5. The numeral 63 designates a support shaft which pivotally connects the handle 61 to the inside of the support shaft 5 with respect to the support shaft. The shaft 63 is loosely inserted into a hole 64 of the cam 9 with the hole 64 being substantially larger in diameter than shaft 63. The numeral 92 designates a fixed shaft laterally extending inside of the lower end of the shaft 5, and the fixed shaft 92 is positioned in the recess 91 provided in the rear half part of the cam 9 and having a slope 93 therein. Accordingly, operation of the handle 61 in the direction R moves handle 61 about support shaft 63 as a center of rotation, with the result that the cam 9 is moved and one component of the movement is in the direction R'. As a result, the cam 9 is moved upward along the inside surface of the shaft 5. However, because the fixed shaft 92 is positioned in the recess 90 of the lower part of the cam 9, the cam 9 moves uniformly downwardly of the ratchet 7 as shown by a broken line in FIG. 6 and depresses the ratchet teeth 7' by the outer circumference of the cam to bring the ratchet teeth 7' of engagement with the ratchet 7. Also, in accordance with the movement of the cam 9, the slope 93 moves in the rear part of the cam 9 to the state of the slope 93 abutting against a fixed shaft 92 (and lower ratchet 7'). The recess 90 formed in the lower part of the guide sheath 3 is intended to receive the cam appearing in time of lock release.

In the above state, locking of the support shaft 5 is released to enable vertical sliding of the shaft along the guide groove 2 in the guide sheath 3.

Next, when the operation of the handle 61 is released, the cam 9 is moved down into the cam groove 9' and the ratchet pawl 7' is returned by the resilience of a leaf spring 10 to its original position, with the result that the headrest 4 is moved down to the position wherein the ratchet pawl 7' is brought into meshing with the ratchet 7 and is locked.

Incidentally, it should be understood that the lock mechanism and lock releasing mechanism described above can be constructed by use of prior art in forms other than that shown above. It should be understood that the mechanism can be constructed by use of, for example, an electronic lock, an electromagnet, or an electromagnetic brake. In short, any type of mechanism may be used as long as it can stop the support shaft at a suitable position within the guide groove 2.

A description will now be given of the general operation and working effect of the device according to the invention.

Figure 5A:
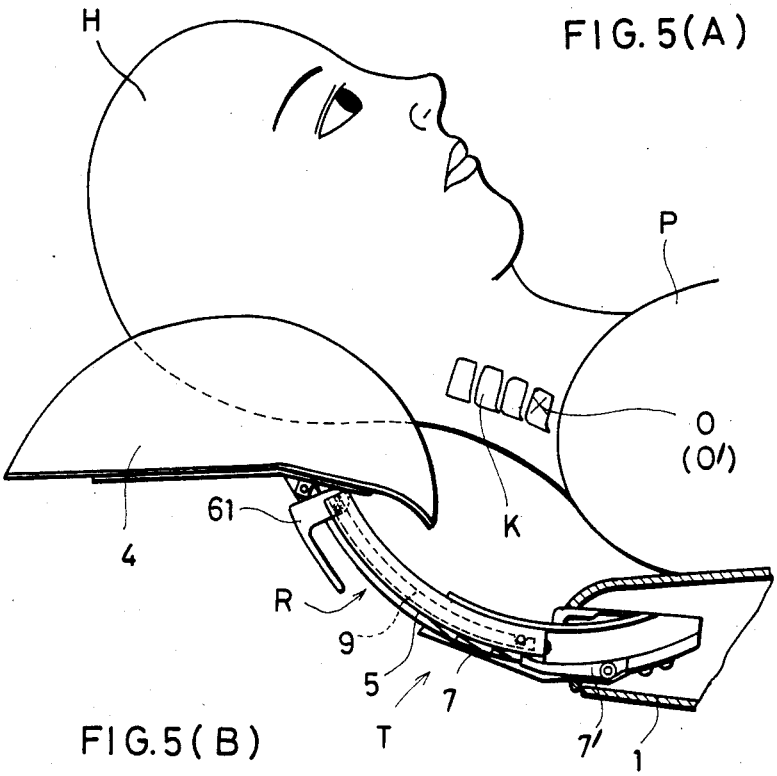
FIG. 5A and 5B is a cross-section of the device in use.
Figure 5B:
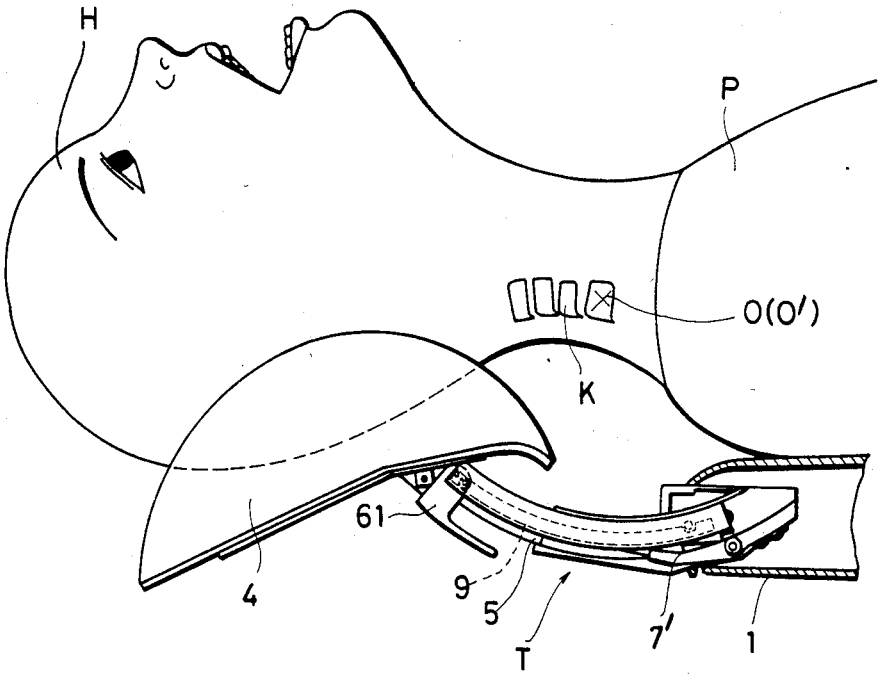

FIGS. 5A and 5B indicate a state of transition from the state which is fit for dental treatment and in which a patient P lies horizontal on the backrest 1 to the state in which the patient is held horizontal so as to make it convenient for an operator (not shown) to perform an operation on the patient. In order to control tilting of the headrest 4 from the state in FIG. 5A to the state in FIG. 5B, the operator may operate the operation handle 61 in the direction R to disengage the ratchet pawl 7' from the ratchet teeth 7 and depress the headrest 4 while supporting the headrest by hand. By so doing, the shaft 5, while sliding along the guide groove 2 of the guide sheath 3, moves down so that the headrest 4 may follow the tilting of a patient P and when the handle 61 is returned, the ratchet teeth 7 of the support shaft 5 meshes with the ratchet pawl 7' and is brought into the state shown in FIG. 5B and stops. Accordingly, according to the invention, even in the case wherein the headrest 4 is moved from the state in FIG. 5A to that in FIG. 5B, the headrest is smoothly tilted without giving pressure on the cervical vertebrae of the patient.

Figure 6:
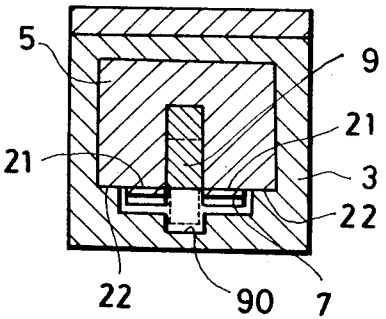
FIG. 6 is a cross-section taken along the line VI—VI of FIG. 3.

Also, when it is desired to erect the headrest 4 from the treatment state in FIG. 5B, the underside of the headrest 4 may be embraced and supported by forearm portion and raised, and thereafter the force to raise the headrest is relaxed. Then, the ratchet pawl 7' will be automatically brought into meshing with the ratchet teeth 7 to thereby lock the shaft 15 at a suitable point in the guide groove 2 of the guide sheath 3. In this case also, the headrest 4 is smoothly tilted without putting pressure on the cervical vertebrae of the patient P. If the device of the invention is provided on both sides of the lower part of the shaft 5 with notches 21, 21 as shown in FIG. 6 and if the guide sheath 3 is provided with protrudent portion which such notches 21, 21 are pushed and inserted, control of tilting of the headrest can be made very smoothly without the lower circumference of the guide sheath 3 being caught by the ratchet teeth 7 formed along the longitudinal extension of the lower circumference of the support shaft 5, and the patient is protected from any undesirable shock during control of tilting of the headrest.

Figure 7:
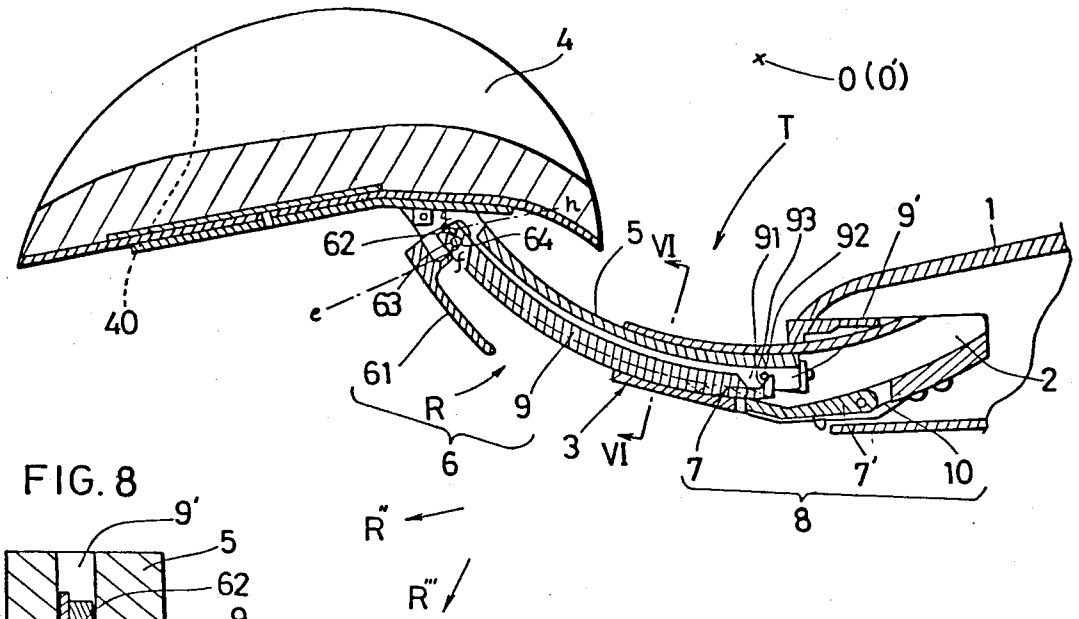
FIG. 7 illustrates the embodiment of FIG. 3 and enlargements of detail thereof with the handle being operated.
Figure 8:
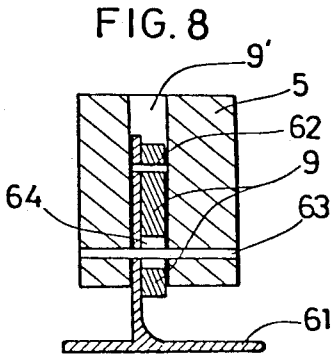
FIG. 8 is a sectional view along the line e-f-g-h of FIG. 7.

More particularly the operation of the apparatus of the present invention can be seen by reference to FIGS. 7 and 8. In the figures, the shaft 63 is fixed to a support shaft 5, and the handle 61 is rotatably supported around the shaft 63 by the operating handle 61 inside a groove 9' provided in the support shaft 51. The handle 61 includes a pivot 62 mounted in a position opposite a handle operating unit with the shaft 63 inside a groove 9', and an arcuate cam 9 is supported rotatably around the handle 61 and pivot 62. Since the shaft 63 passes through a hole 64 in the arcuate cam 9, the bottom end of the arcuate cam 9 by operation of the handle 61 tends to move with one component of the movement being in a direction R″ opposite the direction of the operation R of the handle about the shaft 63 in the range controlled by the hole 64 and the amount of transverse offset between pivot 62 and shaft 63. At this time, since a slope 93 inside a recess 91 in the rear half part of the cam 9 is brought into abutment against a shaft 92 fixed inside a support 5, the cam 9 in its entirety is caused to move with one component of the movement being in a direction R‴ inside a groove 9′ of the support shaft 5. This amount of movement of the cam 9 by the handle 61 is made to be slightly larger than the height of the ratchet teeth 7, and accordingly when the cam 9 is moved to the position shown in broken lines in FIG. 6, a ratchet pawl 7′ is brought out of meshing engagement with the ratchet 7 by being pushed by the cam 9.

As apparent from the detailed description above, the invention is very suitable for use in the treatment of the teeth, eyes, ears and nose wherein treatment must be carried out by always moving the head of a patient placed on the headrest and holding him in a specified supine position in that since the invention makes it possible to control tilting of the headrest in accordance with the movement of the head of the patient placed on the treatment chair, not only the patient need not take a forced position nor feels uncomfortable but the operator also finds it easy to operate the device to the advantage both of the patient and of the operator.

I claim:

1. A device for adjusting an angle of tilting of a headrest as of a treatment table with a backrest movable down to an approximately horizontal position, said device comprising:

a support shaft connected to said headrest which is connected to the backrest of a treatment table and adapted to adjust the angle of tilting of said headrest and having a center of curvature of a curved support positioned at approximately the center of curvature of a curved support shaft positioned at approximately the center of tilting of the cervical vertebrae of a patient on the headrest;

a guide sheath disposed inside the upper portion of the backrest and having a curved guide groove for slidably receiving said support shaft thereinto;

a lock mechanism of said support shaft comprising ratchet teeth provided along the longitudinal direction of the underside of said support shaft and a ratchet pawl adapted to be brought by a spring means into meshing with ratchet teeth on a circumference of the main portion of the guide sheath; and a lock releasing mechanism of said support shaft consisting of an operating handle provided at the upper end of said support shaft and an arcuate cam, said cam being provided along the longitudinal direction of said support shaft and being freely movable into and out of said support shaft by operation of the handle and holding the ratchet pawl in non-meshing relation with the ratchet teeth when said cam moves out of said support shaft.

2. A device according to claim 1, wherein said center of radius of curvature of said shaft is positioned at a point agreeable with or approximate to the center of tilting of the cervical vertebrae of a patient put on said headrest.

3. A device according to claim 1 or 2, wherein said lock mechanism comprises ratchet teeth formed on the lower circumference of said support shaft longitudinally thereof, and a ratchet pawl provided on the underside of a base portion of said guide sheath and pressure in the direction of the pawl being brought by a spring means into meshing with the ratchet teeth, and said lock releasing mechanism comprises an operation handle provided at the upper end portion of said support shaft, and an arcuate cam received in a cam groove, said groove being provided along the direction of said support shaft and having an opening which longitudinally divides said ratchet teeth into two parts, said mechanism being so constructed to depress said ratchet pawl to thereby bring said pawl out of engagement with said ratchet teeth by operation of said handle.

* * * * *